US005501633A

United States Patent [19]

Watkins et al.

[11] Patent Number: 5,501,633

[45] Date of Patent: Mar. 26, 1996

[54] COIN MECHANISM HAVING COIN LEVEL SENSOR

[75] Inventors: Keith J. Watkins, Wokingham; Nigel A. Winstanley, Reading, both of United Kingdom

[73] Assignee: Mars Incorporated, McLean, Va.

[21] Appl. No.: 211,675

[22] PCT Filed: Sep. 21, 1992

[86] PCT No.: PCT/GB92/01735

§ 371 Date: Apr. 12, 1994

§ 102(e) Date: Apr. 12, 1994

[87] PCT Pub. No.: WO93/08544

PCT Pub. Date: Apr. 29, 1993

[30] Foreign Application Priority Data

Oct. 16, 1991 [GB] United Kingdom ..... 9121958

[51] Int. Cl.[6] ..... G07F 9/02

[52] U.S. Cl. ..... 453/17; 250/222.1

[58] Field of Search ..... 453/17; 250/222.1, 250/561

[56] References Cited

U.S. PATENT DOCUMENTS 3,419,725 12/1968 Dwyer ..... 250/222.1

4,286,703 9/1981 Schuller et al. ..... 194/346 X 4,374,529 2/1983 Kobayashi et al. ..... 453/17

FOREIGN PATENT DOCUMENTS 1119532 12/1961 Germany .

2106640 4/1983 United Kingdom .

OTHER PUBLICATIONS

"Coin Sense Unit for Coin Dispenser," IBM Technical Disclosure Bulletin, vol. 29, No. 10B, Mar. 1985, pp. 5956–5957.

*Primary Examiner*—F. J. Bartuska

*Attorney, Agent, or Firm*—Fish & Richardson

[57] ABSTRACT

A coin mechanism having a coin storage tube and an optical sensor for sensing the level of coins in the tube, the sensor comprising a light source arranged to direct a light beam across the tube, a reflector for returning the beam across the tube and a light detector for detecting the returned beam is disclosed. The reflector for returning the beam is a concave mirror having a curvature such as to give the beam an area, where it approaches the detector, substantially greater than the effective area of the detector. This enables, in a compact sensor, the light intensity at the detector to be enhanced and at the same time the sensitivity to misalignment of components to be reduced.

11 Claims, 2 Drawing Sheets

COIN MECHANISM HAVING COIN LEVEL SENSOR

FIELD OF THE INVENTION

This invention relates to coin mechanisms having one or more coin storage tubes, in which the level of coins stored in the storage tubes is sensed, for example, for the purpose of detecting whether the tube is nearly full, or is nearly empty. For the purposes of this specification the term "tube" is used, as is usual in this art, to mean any structure adapted to accommodate coins stacked face-to-face.

BACKGROUND OF THE INVENTION

As is well known, information about the level of coins in coin tubes may be used, among other things, for the purpose of controlling the delivery of tested and accepted coins to the tubes, and the dispensing of coins from the tubes, so as to avoid the problems of attempting to over-fill a tube, which would cause jamming, and attempting to dispense from an empty tube.

In the applicants' EP-B-0017428 there was disclosed an optical sensor which has proved successful and been widely used, in which a light beam from a light source crosses the tube, is internally reflected twice at the wedge-shaped end portions of a trapezoidal prism, so as to turn the beam through 180°, and returns across the tube to a light detector For the purpose of the present specification the term "light" is not of course confined to the optical part of the spectrum.

The above-mentioned arrangement has certain advantages, such as the folded light beam covering a larger area than a straight beam so as to more reliably sense coins which occasionally are at an angle within the tube, and the fact that the source and detector can be at the same side of the tube so that electrical connections can be made from one side only. The prism can be fitted to, or built into, the tube itself.

It has been found, however, that such detectors have limitations which become more severe as the total length of the path of the light beam from the source to the detector increases. In particular, the power available from the beam for activating the detector falls, and this is aggravated by the fact that small relative misalignments of the source, prism and detector further reduce the power that the detector actually receives.

The first of these problems can be reduced by increasing the power input to the source, but this reduces the useful lifetime of the source itself. The second problem can be reduced by increasing the size of the internally reflecting end faces of the prism, so as to increase the area of the light beam that can traverse the system, but this involves making the prism not-only wider, but also deeper, so that it starts to take up an unacceptable volume within the coin mechanism, where compactness is desired. Further disadvantages of such detectors are that light is lost from the beam where it is transmitted through two surfaces of the prism, where it is reflected at two other surfaces of the prism, and also during its transmission through the material of the prism, which further reduces the power available to activate the detector; and, for a given prism size, the area of the beam that can be reflected through 180° is less than half the area of the entry and exit face of the prism because of the need for two independent reflection steps.

SUMMARY OF THE INVENTION

An object of the present invention is to provide a coin mechanism having an optical coin level sensor which suffers less from these disadvantages.

According to the invention there is provided a coin mechanism having a coin storage tube and an optical sensor for sensing the level of coins in the tube, the sensor comprising a light source arranged to direct a light beam across the tube, means for returning the beam across the tube and a light detector for detecting the returned beam, characterised in that the means for returning the beam is a concave mirror having a curvature such as to give the beam an area, where it approaches the detector, substantially greater than the effective area of the detector.

The concave mirror concentrates the flux of the beam, relative to the prior system where only flat internally reflecting surfaces were employed, so that for a given detector size and a given total beam length the light intensity at the detector is increased. The area of the beam at the mirror can be substantially the same size as the mirror itself, so that without the mirror being of greater area than a prism, it can return a beam of greater area so that it is less important for the received beam to be centered exactly on the detector and hence sensitivity to small misalignments of the source, detector and mirror is reduced. Also, the mirror need have relatively little depth and only a small loss of light occurs during the single reflection at the mirror surface.

Hitherto, the applicants had used sensors of the type employing a prism as described above in connection with coin tubes of small and medium diameters, with the prism mounted on the tube to minimise path length. However, for tubes of large diameter intended to contain coins 30 mm or more in diameter, they had used a light source and light detector spaced apart across a chord of the tube so as to minimise the length of the light path. This avoided several of the problems mentioned above, but did not obtain the advantage of the light beam traversing the tube twice.

A particular feature of the invention is to have the source and detector on the one hand, and the mirror on the other hand, spaced relatively widely apart so that the space between them can accommodate coin tubes suitable for storing coins of various diameters, from the smallest up to the largest, often over 30 mm, which it is desired to store. Then, interchangeable coin tubes of various diameters can be fitted in the spaces between the sensor components as described, for example, in the applicant's British patent application no. 9017565.4, which will be briefly summarised below. This enables a standardized sensor layout, with widely spaced components, to be used for all the coin tubes of a mechanism, and tubes of all sizes including those intended to store coins of 30 mm diameter or more can be accommodated at will. Further, the light beam may traverse each tube substantially on a diameter of the tube, even with tubes of the largest sizes required.

In accordance with a further feature of the invention, the curved shape of the mirror is moulded integrally with a plastics frame part of the coin mechanism. Its reflective surface may be on a sheet adhered to said curved shape, for example cut from a larger sheet of self-adhesive reflective material, or may be applied as a coating on said curved shape, for example by metal deposition.

By using such a technique the possibility of mirror misalignment is reduced or eliminated because its alignment is not dependent on the accurate fixing of a relatively small separate component but is determined by the accuracy of moulding of the frame part, which can be made high, and the accuracy of location of the frame part which can also be made high in view of its inevitably greater size than the mirror or any separate mirror-supporting component that might be employed.

BRIEF DESCRIPTION OF THE DRAWINGS

In order that the invention may be more clearly understood an embodiment thereof will now be described, by way of example, with reference to the accompanying diagrammatic drawings in which.

DETAILED DESCRIPTION

Figure 1:
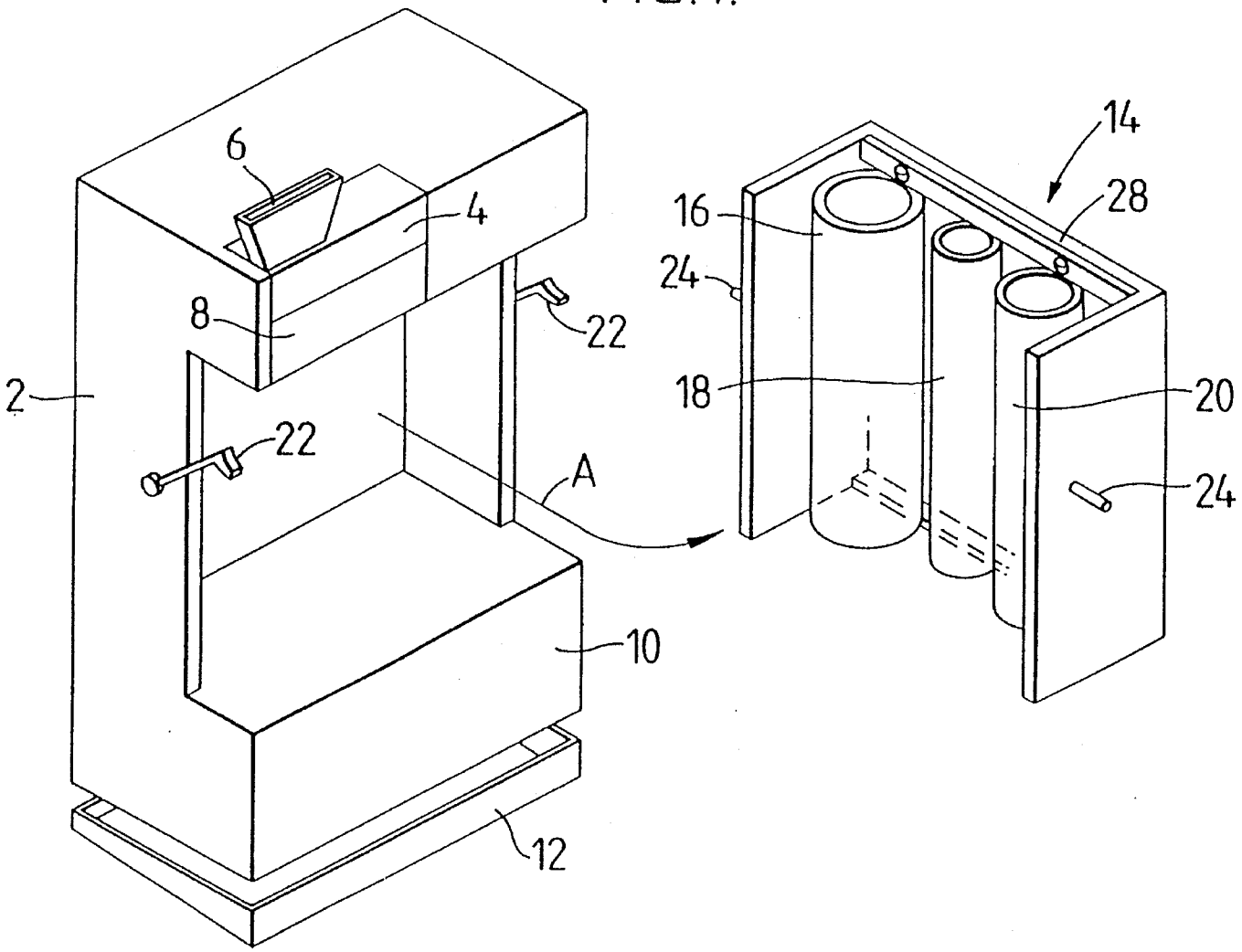
FIG. 1 shows a coin mechanism of the kind described in more detail in above-mentioned British application no. 9017565.4.

The coin testing mechanism shown in FIG. 1 includes a main frame 2 into which is fitted a coin tester or validator 4 having a coin inlet 6. Acceptable coins pass to a coin separator 8 which routes them, according to their denomination as determined by the testing section 4, to respective coin storage tubes each of which is for receiving one particular denomination, or alternatively to a cashbox. A coin dispensing section 10 is located below the coin tubes and may be of conventional kind, the dispensed coins falling into a tray 12 beneath the mechanism for collection by the user.

A cassette is shown generally at 14, which includes three coin tubes 16, 18 and 20 (though in practice four tubes would often be present, or perhaps more). In its operative position, the cassette fits into the recess at the front of the coin testing mechanism as illustrated in FIG. 1, where it is held by hand-operable fastening means such as the pivotable hooks 22 which can be engaged over pegs 24 located on either side of the cassette. This enables easy removal of the cassette from the mechanism as illustrated by the arrow A and also easy replacement of the cassette in the mechanism.

The three coin tubes may all be substantially the same, apart from their diameters, though of course it will not normally be necessary for every coin tube in a mechanism to be different from that of all the other coin tubes. The coin tubes are readily detachable from the cassette, so that it can easily be provided with the particular combination of tube diameters that are required for each specific application.

Figure 2:
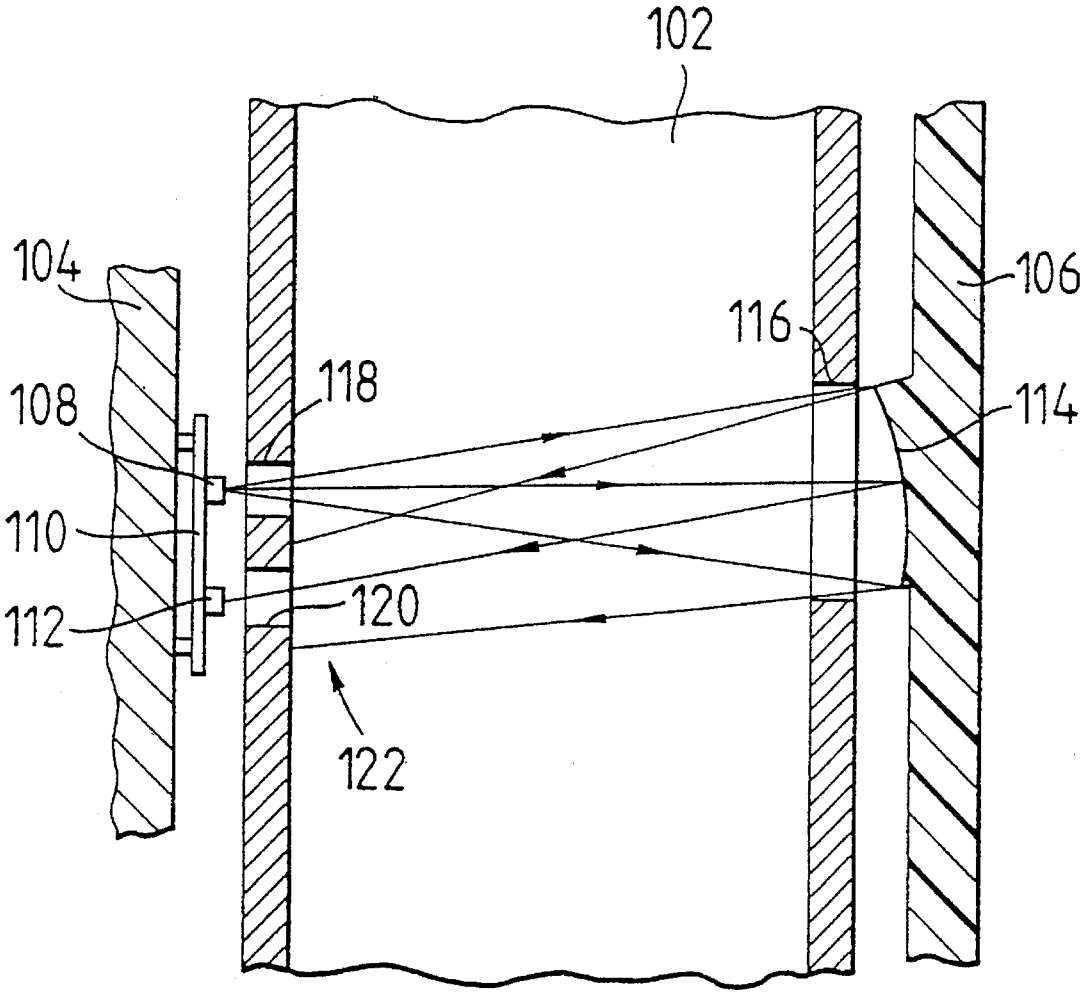
FIG. 2 shows a cross-section on the axis of a coin tube of a coin mechanism in accordance with the invention, and adjacent frame parts of the mechanism.

Turning now to FIG. 2, a coin tube 102 is located between frame parts 104 and 106, respectively, of the coin mechanism. The exact manner of mounting is immaterial but the tube may be mounted in a cassette 14 as described above, in which case the frame part 106 may be the front wall 28 of the cassette and the frame part 104 may be the rear wall of the recess in the main frame of the mechanism in which the cassette is accommodated. As illustrated in FIG. 2, coin tube 102 is a large one of substantially the maximum diameter that could be accommodated between frame parts 104 and 106, but other coin tubes in the same mechanism may be of smaller diameters even though the spacing between frame parts 104 and 106 is constant across all the coin tubes.

A light source 108 such as an LED, is mounted on a small printed circuit board 110, which in turn is mounted on frame part 104. A light detector 112, such as a phototransistor, is also mounted on printed circuit board 110.

A concave shape 114 is integrally molded on frame part 106, which is of a plastics material, and is provided with a reflective coating either by having a sheet of reflective material adhered to it or by having a reflective material deposited upon it. This forms a concave mirror. It will be appreciated that this avoids the need for an extra step of fixing a mirror or a mirror-carrying component to the frame of the mechanism. In this embodiment the mirror is concave in the top-to-bottom direction, but not across its width, because vertical misalignment is the main problem but it could be made wider, and concave across its width, if lateral misalignment were more likely to occur. The radius of curvature of the mirror is 66 mm, but it might range from 40 mm to 90 mm according to the application, and similar radii could be used if the mirror were curved across its width.

An aperture 116 in coin tube 102 is large enough to enable the full surface area of the mirror to be utilised for reflecting a light beam which crosses the tube twice, as indicated by the arrowheads, which are applied to the central ray, and the extreme rays, of that part of the beam emitted from the centre of the light source 108.

Across a diameter of the tube from aperture 116, there is an aperture 118 sufficiently large to pass all the rays that are capable of striking the mirror and adjacent to the detector 112 is an aperture 120 large enough not to prevent any of the beam being returned from the mirror from striking the detector 112. The benefits of the invention are most apparent when the length of the light path from the source to the detector is at least 40 mm, and it may be 50 mm or more, the length being 60 mm in this embodiment.

It will be appreciated that when coins in tube 102 build up to a level which cuts or substantially reduces either of the outward and return paths of the light beam, the resulting reduction in output from detector 112 enables this to be sensed. Similarly, if an existing stack of coins in the tube falls below a level such as to enable substantial completion of the light beam, the electrical output of detector 112 increases which enables this condition also to be sensed.

It can be seen from FIG. 2 that, unlike the typical situation when a prism is used (when the light beam becomes progressively broader as it travels out from the source and back to the detector with a resultant constant reduction of its intensity) the beam is concentrated or narrowed by the concave mirror on its return path towards the detector 112 so that its intensity when it reaches the detector is higher than it was when it reached the mirror.

The mirror can be many times the size of the detector 112, the mirror area preferably being at least 20 $mm^2$ and, in the particular embodiment, over 40 $mm^2$, namely 72 $mm^2$, its measurements being 12 mm in height and 6 mm in width. The area of the beam in the region 122 where it is approaching detector 112 can consequently be several times (preferably at least four times) the area of the detector and consequently performance is relatively insensitive to misalignment of frame part 106 since the beam can become significantly off-centre relative to the detector 112 before any significant reduction of received intensity occurs.

In one practical arrangement, the detector 112 is a phototransistor with an effective diameter of 1.5 mm, but other types of detectors having effective diameters up to 5.0 mm or even 7.5 mm could be employed. The possibility of significant misalignment is minimised by having the shape of the mirror surface formed integrally with the frame part 106.

In general, in terms of the power input needed to the light source 108, and the intensity of light available at detector 112, the embodiment shown has the performance of a prior art system using a trapezoidal prism, as described above, in which the total length of the beam from source to detector is only approximately half of that shown, when the major dimension of the prism is about the same as the major dimension of the mirror. That is, the path length is doubled without loss of performance.

We claim:

1. A coin mechanism having a coin storage tube and an optical sensor for sensing the level of coins in the tube, the sensor comprising a light source arranged to direct a light beam across the tube, means for returning the beam across the tube and a light detector for detecting the returned beam, wherein the means for returning the beam is a concave mirror having a curvature such as to give the beam a projected area at the detector, substantially greater than the effective area of the detector.

2. A coin mechanism as claimed in claim 1 wherein said area of the beam is at least 4 times the area of the detector.

3. A coin mechanism as claimed in claim 1 wherein the area of the mirror is at least 20 $mm^2$.

4. A coin mechanism as claimed in claim 1 wherein the length of the beam from the source to the detector is at least 40 mm.

5. A coin mechanism as claimed in claim 1 wherein the concave shape of the mirror is moulded integrally with a plastics frame part of the coin mechanism.

6. A coin mechanism as claimed in claim 5 wherein the reflective surface of the mirror is on a sheet adhered to said concave shape.

7. A coin mechanism as claimed in claim 5 wherein the reflective surface of the mirror is a coating on said curved shape.

8. A coin mechanism as claimed in claim 1 wherein the source, detector and mirror are supported on parts of the coin mechanism other than the coin tube.

9. A coin mechanism as claimed in claim 8 adapted to accommodate a coin tube for coins of at least 30 mm diameter between the source and the detector, and the mirror.

10. A coin mechanism as claimed in claim 9 having a plurality of coin tubes, and a respective such sensor for each said tube, and adapted to accommodate a tube for coins of at least 30 mm diameter at the location of each said tube.

11. A coin mechanism as claimed in claim 1 wherein the light beam passes across substantially the full diameter of the or each tube.

* * * * *